US007550868B2

(12) United States Patent
Fumery et al.

(10) Patent No.: US 7,550,868 B2
(45) Date of Patent: Jun. 23, 2009

(54) DEVICE FOR DESPATCHING A SECURE OUTPUT COMMAND

(75) Inventors: Benoît Fumery, Bures sur Yvette (FR); Pierre Capdevila, Levallois Perret (FR)

(73) Assignee: Siemens Transportation Systems SAS, Montrouge (FR)

( * ) Notice: Subject to any disclaimer, the term of this patent is extended or adjusted under 35 U.S.C. 154(b) by 792 days.

(21) Appl. No.: 11/245,487

(22) Filed: Oct. 5, 2005

(65) Prior Publication Data

US 2006/0138865 A1 Jun. 29, 2006

(30) Foreign Application Priority Data

Oct. 7, 2004 (FR) ..... 04 10603

(51) Int. Cl.
*H01H 47/00* (2006.01)

(52) U.S. Cl. ..... 307/10.5; 307/10.2; 307/10.3; 307/10.4; 307/9.1; 340/5.1; 340/5.2; 340/5.21; 340/5.26

(58) Field of Classification Search ..... 307/10.5, 307/9.1, 10.2, 10.3, 10.4; 340/5.1, 5.2, 5.21, 340/5.26

See application file for complete search history.

(56) References Cited

U.S. PATENT DOCUMENTS 4,747,120 A * 5/1988 Foley ..... 379/38
4,782,510 A * 11/1988 Szlam ..... 379/88.24
5,825,790 A * 10/1998 Lawandy ..... 372/23
5,901,156 A * 5/1999 Botzenhardt et al. ..... 714/748

FOREIGN PATENT DOCUMENTS

EP 1 453 072 A1 9/2004
FR 2 704 370 10/1994

* cited by examiner

*Primary Examiner*—Albert W Paladini
(74) *Attorney, Agent, or Firm*—Laurence A. Greenberg; Werner H. Stemer; Ralph E. Locher

(57) ABSTRACT

The invention aims to provide a compact device for despatching a command. For this purpose, the invention proposes a novel type of output stage. A secure verification device of the despatching of a binary command signal from at least one conductor has an input terminal and an output terminal. Means of insertion despatch a verification message on said conductor. At least one optical coupler has an emission diode coupled to the conductor so as to copy the verification message when the binary signal is in a first state and not to copy it when it is in a second state different from the first state.

26 Claims, 3 Drawing Sheets

DEVICE FOR DESPATCHING A SECURE OUTPUT COMMAND

BACKGROUND OF THE INVENTION

The invention relates to a device for despatching a secure output command. This type of device is used in applications requiring high security monitoring such as, for example, applications of transport of people.

For the transport of people, such as by train, subway, tramway or self-steered bus, it is necessary to exhibit maximum security in order to have authorization to travel. Among the security arrangements implemented, a particular arrangement consists in the use, for any logic level corresponding to a command, of a security level, that is to say one which is not dangerous in the event of malfunction. The security level is generally the zero level corresponding moreover to an absence of voltage or current. One speaks of the permissive state and the restrictive state. The permissive state corresponds to a command in a state that is nonsecure but necessary for operation, for example, request for traction or release of the brakes. The restrictive state prohibits certain operating actions or brings about actions whose effect is secure, for example stoppage of traction or triggering braking, and in particular in case of absence of energy so as to make the passengers secure whatever happens.

In order to guarantee fully secure operation in the event of failure of any one of the components of the command system, any fault must result in the setting of a restrictive state. In order to ensure such security setting, the mere failure of a component must bring about either a setting of the command to the restrictive state, or a detection of malfunction which globally sets all the outputs into a restrictive state.

With this aim, each command despatch device is furnished with a so-called security output device which serves, on the one hand, to despatch a power command and, on the other hand, to verify that the signal is indeed in a restrictive state when a restrictive state is requested. The monitoring of the security outputs makes it possible to guarantee that a command device will not command an action wrongly. The principle is to operationally command an output and to verify its state in a secure manner. In the event of a problem, a secure energy supply is cut, thus forcing all the command signals into a security state.

Static security relays for producing such a command interface monitored securely are known in particular from French patent application FR-A-2 704 370. According to this document, the power command is transmitted by way of a transformer with four windings, including primary and secondary windings for state verification and primary and secondary power windings. The primary state verification winding receives a monitoring signal which is read by the corresponding secondary winding. When a command is in a permissive state, the primary power winding of this same transformer receives considerable energy destined for the secondary power winding. When the primary power winding receives this energy, the transformer becomes saturated and the secondary monitoring winding is no longer capable of receiving the signal despatched by the primary monitoring winding. Such a device is sufficiently effective for the function requested. However its main drawback is that it is rather bulky and consumes appreciable energy.

The invention aims to provide a compact device for despatching a command. For this purpose, the invention proposes a novel type of output stage. A monitoring signal is despatched on the power conductors. The monitoring signal is recovered by way of an optocoupler linked to the conductor.

SUMMARY OF THE INVENTION

The invention is a secure verification device of the despatching of a binary command signal on at least one conductor having an input terminal and an output terminal. Means for insertion despatch a verification message on said conductor. At least one optical coupler has an emission diode coupled to the conductor so as to copy the verification message when the binary signal is in a first state and not to copy it when it is in a second state different from the first state.

Preferably, a first conductor is furnished with a first monitoring diode placed between its input terminal and its output terminal, said diode being placed so as to be disabled when the binary signal is in the first state and so as to allow the current to pass through the first conductor when the binary signal is in the second state. The means of insertion comprise a transistor which couples in parallel a first emission diode with the first monitoring diode when said transistor is enabled, the first emission diode being biased in such a way that the latter is disabled independently of the state of the transistor when said first monitoring diode is enabled. The device comprises biasing means which make it possible to reverse bias the first monitoring diode when the binary signal is in the first state.

Moreover, the device may furthermore comprise second means of insertion of a verification signal on a second conductor, and a second optical coupler having a second emission diode coupled to the second conductor so as to copy the verification message when the binary signal is in a first state and not to copy it when it is in a second state different from the first state.

According to another variant, the binary command signal is a power command despatched on two conductors creating a continuous secure potential difference between the two conductors when the binary signal is in the second state and allowing said conductors to float when the binary signal is in the first state. The means of insertion consist of a capacitor and two resistors coupled to the conductors and despatching a differential verification message, of variable potential, whose amplitude is less than the secure potential difference. The emission diode is placed between the two conductors in such a way as to be disabled when the secure potential difference is applied to said conductors.

The invention, in a more global manner, is also a secure command system comprising: means of generation of a command, means of verification which verify the proper operation of said system, means of secure energizing which provide a security voltage under the monitoring of the verification means, means of despatch of the command in a secure manner with the aid of the security voltage. The means of despatch comprise at least one security device for verifying the despatch of a binary command signal as described previously.

Of course, the invention also covers the vehicle containing the secure command system.

DESCRIPTION OF PREFERRED EMBODIMENTS

Figure 1:
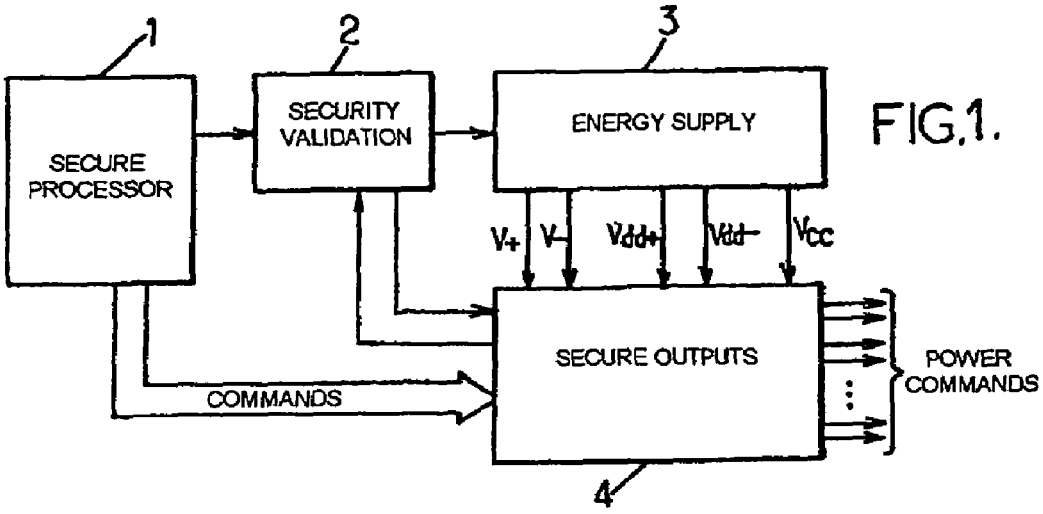
FIG. 1 represents an exemplary secure circuit for generating commands.

The secure generator of commands which is represented in FIG. 1 comprises:

a secure processor 1 which formulates commands as a function of input data and of a program produced in a secure manner, that is to say self-verifying that it is running properly, a security validation circuit 2 which receives, from the secure processor 1, the state of the commands which have to be despatched as well as signatures of errors representative of any errors detected in the course of the running of the program of said processor 1, a secure energy supply 3 commanded by the security validation circuit 2 which will provide or not provide a security voltage $V_{sec}=V_{+}-V_{-}$, depending on whether or not an error has been detected by the security validation circuit 2, and a secure output interface 4 which receives the commands to be despatched to remote devices originating from the secure processor 1, monitoring signals originating from the security validation circuit 2, various supply voltages $V_{+}$, $V_{-}$, $V_{DD+}$, $V_{DD-}$ and $V_{CC}$ provided by the security energy supply circuit 3; the secure output circuit 4 also despatches to the security validation circuit 2 signals representative of the actual state of the power outputs.

During the running of the program, the secure processor 1 auto-verifies its proper operation. Security signatures are despatched to the security validation circuit 2 which will validate that the program has run correctly without any error. Furthermore, the secure processor 1 provides the security validation circuit 2 with the states of the requested outputs.

The security validation circuit 2 verifies the proper operation of the whole of the device intended to despatch commands. If an error is ever detected, the security validation circuit cuts off the power supply which corresponds to the security voltage $V_{sec}=V_{+}-V_{-}$ and which supplies the secure output interface so that no command can be despatched and that all the output signals are again in a restrictive so-called security state.

Figure 2:
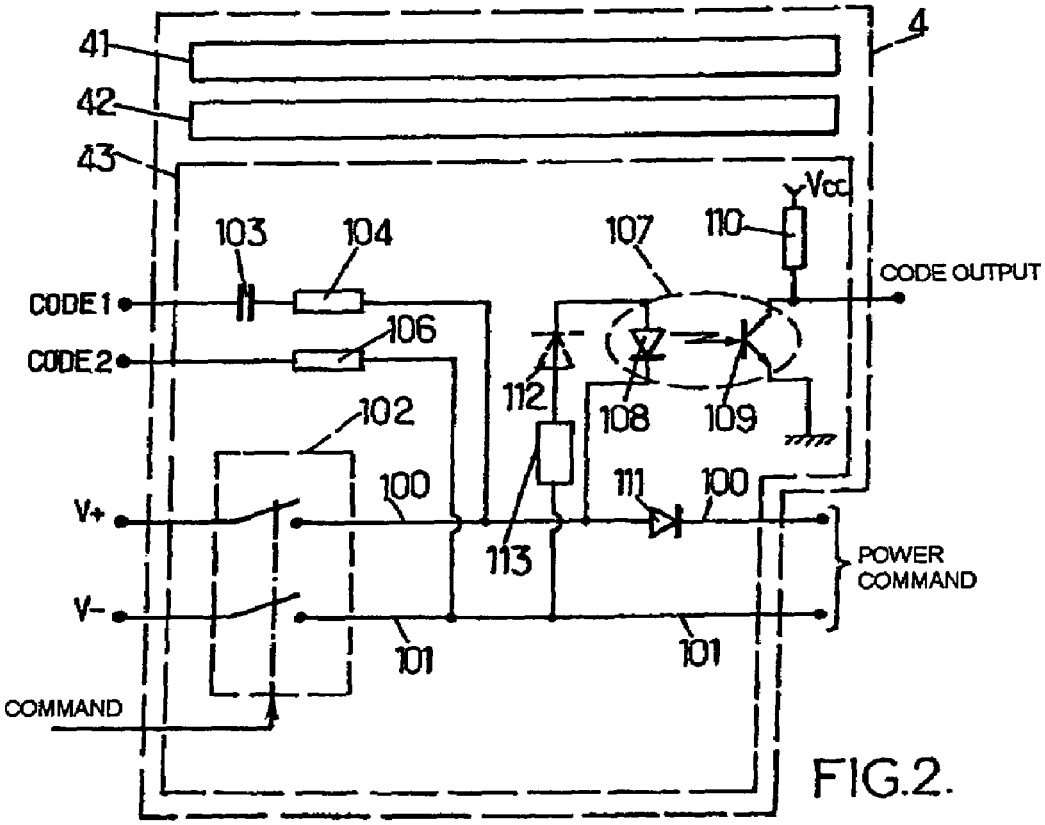
FIGS. 2 to 5 represent various exemplary embodiments of a secure output according to the invention.

FIG. 2 represents a first exemplary embodiment of the secure output interface 4 which comprises a plurality of secure output circuits 41 to 43. Each secure output circuit 41 to 43 is dedicated to the transmission of a command signal specific to it. The secure output circuit 43 comprises two conductors 100 and 101. The conductors 100 and 101 are intended to convey a binary power output signal. For this purpose, a binary command signal controls a switching device 102 which links the conductor 100 to the supply voltage $V_{+}$ and the conductor 101 to the supply voltage $V_{-}$. The supply voltages $V_{+}$ and $V_{-}$ are provided by the security supply 3 when the security validation circuit authorizes the security voltage $V_{sec}=V_{+}$ and $V_{-}$ which is equal to, for example, 48 volts. In case of detection of a malfunction, the supply voltages $V_{+}$ and $V_{-}$ are no longer provided so that the state of all the outputs of the secure output interface are again in a security state. The conductors 100 and 101 therefore provide a power command when the command signal closes the switching circuit 102. The conductors 100 and 101 are linked to a load, for example a remote relay, not represented in this FIG. 2.

The security or restrictive state corresponds to an opening of the switch 102. One seeks to verify that when this security state is requested, it is indeed applied by the secure output circuit 43.

A verification code, for example a pseudo random train of bits, is provided to the device to the output circuit 43 by the security validation circuit 2. The verification code is despatched on the conductors 100 and 101 by way of two code inputs denoted CODE1 and CODE2. The input CODE1 is coupled to the conductor 100 by way of a capacitor 103 and a resistor 104. The input CODE2 is coupled to the conductor 101 by way of a resistor 106.

An optocoupler 107 consisting of an emission photodiode 108 and of a reception phototransistor 109 is coupled to the conductors 100 and 101 so as to recover the verification code and provide it on an output. The emission photodiode 108 is connected between the conductors 100 and 101 so as to copy the code originating from the code inputs when the binary command signal is in a first state, for example the security state, and not to copy it when it is in a second state different from the first.

For this purpose, the photodiode 108 is biased so that the latter is again in a disabled state when the switch 102 establishes contact between the conductors 100 and 101 and the security voltage $V_{sec}$. When one wishes to have a security level on this output, the binary command signal is in a state which requests the opening of the switch 102. If the switch 102 is found to be unexpectedly closed, then the photodiode 108 is again disabled. The code despatched by the inputs CODE1 and CODE2 will not cross through said photodiode. Thus, the latter will emit absolutely nothing and the phototransistor will be totally unable to copy the signal onto its output.

On the other hand, if the switching circuit 102 responds correctly to the binary command signal, then the conductors 100 and 101 are no longer linked to the security voltage $V_{sec}$. The code signals are despatched on the conductors 100 and 101, and they cross through the photodiode 108 when the potential difference between the code inputs biases said photodiode 108 in a forward direction. The phototransistor 109 then receives the emission of the photodiode and switches a resistor 110 between earth and a supply voltage $V_{CC}$, for example 5V. The code output, corresponding to the node between the transistor 109 and the resistor 110, is then found to be modulated by the verification code. The code output is thereafter despatched to the security validation circuit 2 for verification of the code. The output code is then equal to:

$$\text{OUTPUT CODE} = \overline{\text{CODE1} \cdot \overline{\text{CODE2}}}$$

This first embodiment fulfills the desired security conditions perfectly. However, when a load of high power and hence of low impedance is linked to the conductors 100 and 101, it might diminish the voltage of the signals provided to the inputs CODE1 and CODE2 across the terminals of the photodiode 108. In order to remedy this problem, a switching diode 111 is inserted on one of the conductors so as to prevent the current corresponding to the code signals from crossing through the load.

Likewise, the photodiode 108 is reverse biased with respect to the security voltage which crosses through the conductors 100 and 101. This may pose a problem if the load is of inductive type. When a relay is connected across the output terminals of the two conductors 100 and 101 then the photodiode 108 acts as a freewheel diode. Acting as a freewheel diode, the photodiode 108 ensures the sticking for a not necessarily defined duration of the relay that the conductors 100 and 101 command. In order to remedy this, a resistor 113 is inserted between one of the conductors and the photodiode 108. The value of this resistor is chosen to be much greater than the impedance of the commanded relay so as to limit current to the maximum when the latter goes in a direction reverse to the current provided by the security voltage $V_{sec}$, greatly reducing the freewheel created by the photodiode.

The two resistors 104 and 106 serve to limit the current of the signal corresponding to the verification code so that the latter is less than the minimum current that can trigger the relay serving as load. Although the maximum voltage in absolute value of the code signals is low, for example +5V or −5V, these resistors 104 and 106 dissipate non-zero energy thermally. The coupling capacitor 103 nevertheless makes it possible to limit the current in these resistors. The capacitor 103 must be sized so as to support a potential difference that may be greater than the security voltage $V_{sec}$ i.e. 48 volts, but they eliminate the static consumption of the resistors 104 and 106.

The connecting of the emission photodiode 108 between the two conductors 100 and 101 has the drawback of reverse biasing the photodiode 108 with a relatively high voltage of the order of 48 volts. This type of component is not generally made to support such voltages. Moreover, when the power element to be commanded is far from the output circuit, the constraints related to the electromagnetic environment become significant. In such a situation, the connecting of the code inputs to the conductors 100 and 101 by way of capacitors does not exhibit a sufficiently significant galvanic isolation and parasitic signals of electromagnetic origin may impair the shape of the bit train constituting the verification code.

In order to remedy the aforesaid drawbacks, various improvements will be detailed in succession. Firstly, according to a variant embodiment, a switching diode 112 is placed in series with the photodiode 108 with a bias of like sense. The switching diode 112 makes it possible to reduce the reverse voltage across the terminals of the photodiode 108.

Figure 3:
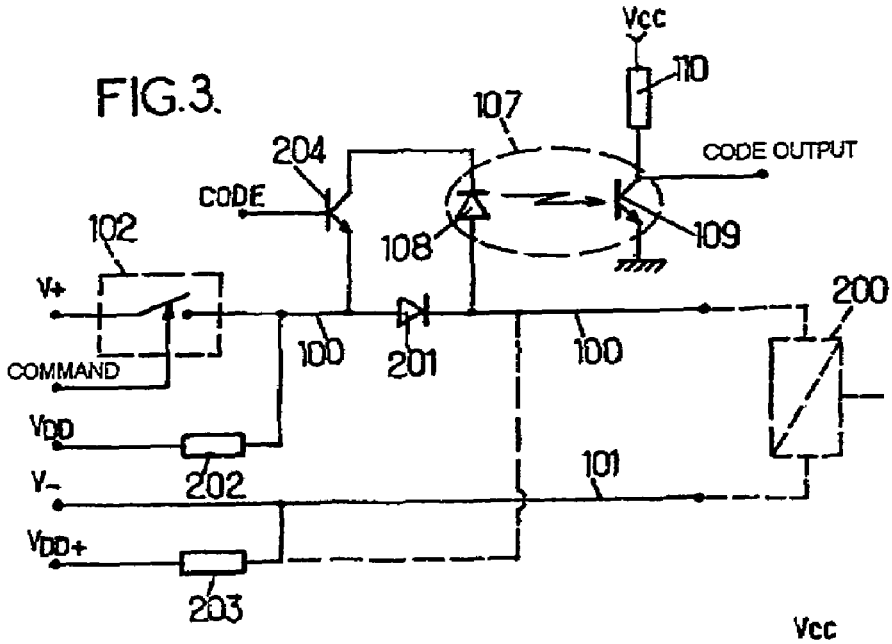

A variant circuit is represented in FIG. 3. The conductors 100 and 101 are linked to a load 200. The load 200 is for example a control coil of a relay. In this example, the conductor 100 alone has the switching circuit 102 at input. The output state monitoring is done by monitoring the state of the current flowing through the conductor 100. For this purpose, a switching diode 201 is inserted on this conductor 100, this switching diode 201 being biased so as to be enabled when the switching circuit 102 closes the circuit. A bias voltage $V_{DD}=V_{DD+}-V_{DD-}$ is coupled to the conductor 100 by way of the resistors 202 and 203. This coupling is effected so as to reverse bias the switching diode 201 in relation to the bias voltage $V_{DD-}$. In parallel with the diode 201, the emission photodiode 108 of the optocoupler 107 is connected by way of a transistor 204. The transistor 204, for example an NPN transistor, receives the verification code on its base.

The bias voltage $V_{DD}$, for example 12 V, may be applied either to both conductors 100 and 101 or solely to the conductor 100. In the case where it is applied to both conductors 100 and 101, a bias voltage crosses the load 200. The resistors 202 and 203 are chosen so as to limit the current flowing through the load to a threshold below a relay-triggering current.

Preferably, in order to prevent possible triggering of the relay 200 if the latter is of low power, it is possible to use a biased relay. The biasing of the relay 200 makes it possible to authorize its triggering when it is biased by the security voltage $V_{sec}$ but not by the bias voltage $V_{DD}$. The biased relay is preferably the device commanded by the conductors 100 and 101 so as to serve as complementary protection in addition to the means described in the variants described hereinbelow and which are likewise aimed at avoiding unexpected triggering of the relay.

When the switch 102 is closed, the conductors 100 and 101 supply the load 200 with a security voltage $V_{sec}$. The diode 201 becomes enabled, the voltage across the terminals of this diode 201 is substantially equal to its threshold voltage, that is to say 0.6 volts. This voltage across the terminals of the diode 201 does not allow the diode 108 to conduct, thus the reception phototransistor 109 cannot receive the code despatched by way of the transistor 204.

When the switching circuit 102 is open and when no power current corresponding to the command signal passes through the conductors 100 and 101, the diode 201 is disabled by the bias voltage $V_{DD}$ across its terminals. The bias voltage $V_{DD}$ then biases the branch consisting of the photodiode 108 and the transistor 204. Thus, when the base of the transistor 204 is modulated in all or nothing mode by the verification code, this code is echoed in the diode 108 which will emit as a function of said code. The transistor 109 will therefore receive the code and transmit it to the code output.

The galvanic isolation may appear to be insufficient at the code input level, in particular if one wishes to use a more significant security voltage. Specifically, the transistor 204 may burn out and damage the security validation circuit 2 if by way thereof a significant voltage returns upstream. Moreover, the bias voltage $V_{DD}$ is of the order of 12 volts whereas the security voltage $V_{sec}$ is of the order of 48 volts, these voltages being moreover connected in a reverse manner, the potential differences across the terminals of the resistors 202 and 203 may reach 60 volts, this leading to a relatively significant and unnecessary energy dissipation.

Figure 4:
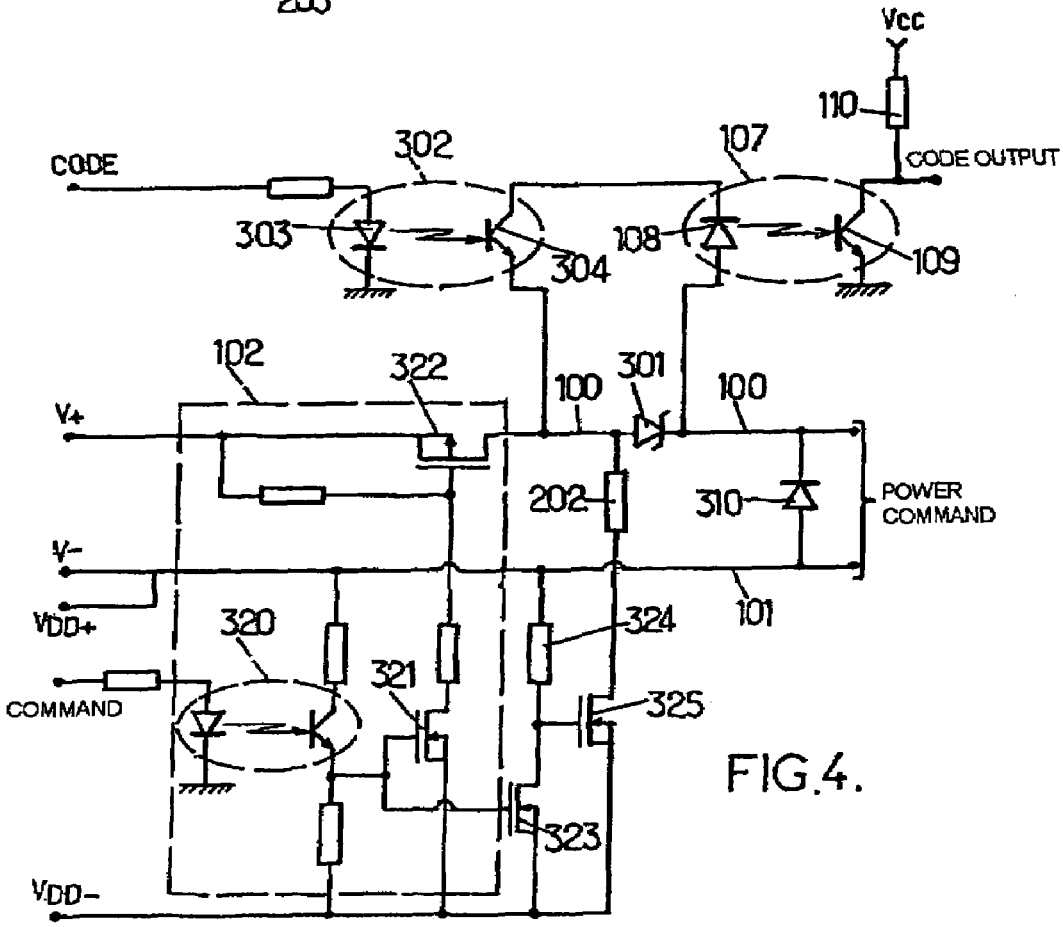

The circuit of FIG. 4 corresponds to another variant which exhibits various advantages. The bias voltage $V_{DD}$ is applied to the conductors 100 and 101 by way of a single resistor 202 but only when the switching circuit 102 is supposed to be open. The switching diode 201 is here replaced with a Zener diode 301 intended, when biased, to guarantee a maximum voltage across the terminals of the branch consisting of the photodiode 108 and of a phototransistor 304 replacing the transistor 204.

The code is provided here by way of an optocoupler 302 which comprises an emission photodiode 303 and a reception phototransistor 304. In order to prevent a current from crossing the load, a biasing diode 310 is placed between the two conductors 100 and 101 at the level of their outputs. The biasing diode 310 is biased so that it is disabled when the security voltage $V_{sec}$ is applied to the conductors 100 and 101. When the bias voltage $V_{DD}$ is applied to the conductors 100 and 101, the biasing diode 310 becomes enabled.

The switching circuit 102 and an MOS transistor circuit coupled to the command signal by way of an optocoupler 320. The outgoing signal leaving the optocoupler 320 commands an MOS transistor 321, itself commanding an MOS transistor 322. The MOS transistor 322 ensuring the connecting or the disconnecting of the conductor 100 with the supply voltage $V_{+}$. An MOS transistor 323 coupled to a resistor 324 also receives the same command signal as the MOS transistor 321. Now, this assembly reverses the signal so as to command an MOS transistor 325 which links the supply voltage $V_{DD-}$ to the conductor 100 by way of the resistor 202. The supply voltage $V_{DD+}$ is connected directly to the supply voltage $V_{-}$. With such a circuit, the manner of operation is globally the same as the previous operation. However, the consumption of the resistor 202 is found to be greatly reduced, by virtue of the breaker thus constituted which establishes the link between the conductor 100 and the supply voltage $V_{DD-}$ when the command signal is in the first state and which disconnects this supply voltage $V_{DD-}$ from said conductor 100 when the command signal is in the second state.

Among other advantages, any possible overvoltage at the level of the photodiode 108 is found to be limited by the Zener diode 301. The use of an optocoupler 302 and 320 makes it possible to have excellent galvanic isolation at the level, on the one hand, of the command input and, on the other hand, of the code input.

However, the circuit may still be improved. The biasing diode 310 may behave as a freewheel diode with respect to an inductive load. The Zener diode 301 is found to be relatively expensive if one wishes that it ensure good switching performance and that it be traversed by a strong current when it is forward biased.

A drawback may be that a short-circuit occurs downstream of the output of the conductor 100, for example a short-circuit with the output of another energized conductor could be envisaged in certain cases. Detection on a single conductor does not make it possible to circumvent such a case.

Figure 5:
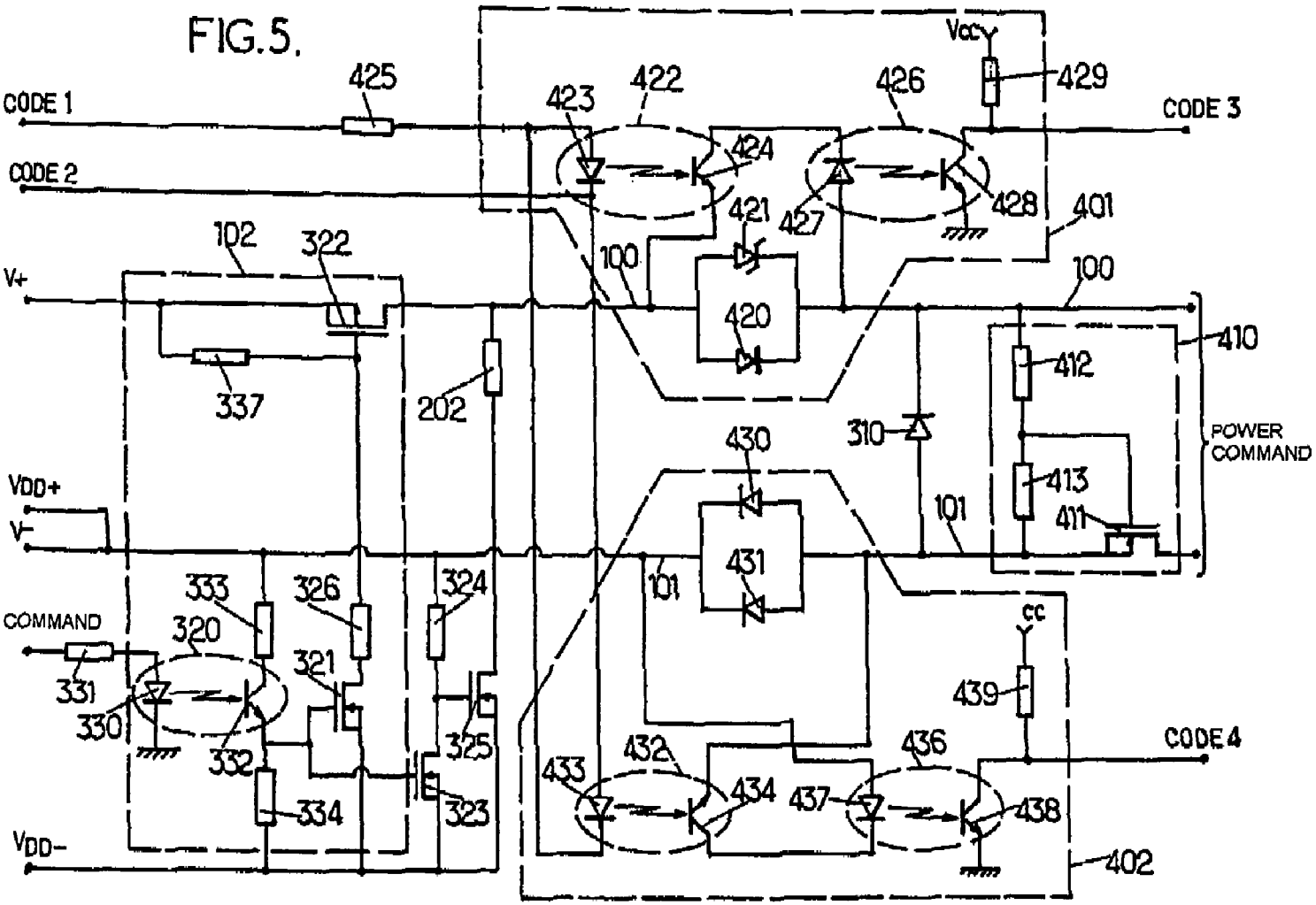

The circuit of FIG. 5 represents a still improved variant. In the circuit of FIG. 5, the conductor 100 is furnished with a verification circuit 401 and the conductor 101 is furnished with a verification circuit 402. The transmission of a binary command signal is done by way of the switching circuit 102 which switches the supply voltage $V_+$ with the aid of the MOS transistor 322. The biasing of the verification circuits 401 and 402 with the aid of the bias voltage $V_{DD}$ linked to the conductors 100 and 101 is done by way of a resistor 202 and the MOS transistor 325 operating in reverse manner with respect to the MOS transistor 322. The biasing diode 310 placed between the conductors 100 and 101 is biased so as to be enabled in relation to the bias voltage $V_{DD}$ and disabled in relation to the security voltage $V_{sec}$, serves to ensure the biasing of the verification circuits 401 and 402 without passing through the load (not represented). In order to prevent this biasing diode 310 from behaving as a freewheel diode, an auto-switching circuit 410 is placed between the output terminals of said conductors 100 and 101 so as to connect or disconnect the conductor 101 of a load linked to said conductor 101.

The autoswitching circuit 410 consists, for example, of an MOS transistor 411 a control gate of which is linked to the midpoint of a voltage divider bridge consisting of the resistors 412 and 413. When the voltage across the terminals of the bridge of resistors 412 and 413 corresponds to the security voltage, the voltage across the terminals of the resistor 413 is greater than a threshold voltage of the MOS transistor 411 which then links the conductor 101 of the link. When the voltage across the terminals of the bridge of resistors 412 and 413 corresponds to a voltage which is zero or less than a threshold voltage of the transistor 411, the latter is then disabled and the conductor 101 is then disconnected from the load.

The verification circuits 401 and 402 are of a similar type. However, they operate in a reverse manner with respect to one another so as to recover, on the one hand, an output representative of the code and, on the other hand, an output representative of the code reversed. For this purpose, the code is provided on two differential code inputs, denoted CODE1 and CODE2, which each receive a different signal of pseudo-random type.

The verification circuit 401 comprises a diode device inserted onto the conductor 100. The diode device here consists of a switching diode 420 coupled in parallel with a Zener diode 421. The coupling of the Zener diode 421 with the switching diode 420 has the effect of having all the advantages of a Zener diode as regards the biasing of the circuit as indicated previously with the circuit of FIG. 4 as well as all the advantages of a switching diode in terms of significant current and switching time. Furthermore, a switching diode generally has a threshold voltage that is lower than a threshold voltage of a Zener diode, thereby causing the switching diode 420 to disable the Zener diode 421 when this diode 420 is enabled, thus preventing unnecessary fatigue to the Zener diode 421.

An optocoupler 422 comprising an emission photodiode 423 and a phototransistor 424 serves to provide the conductor 100 with the verification code. The photodiode 423 is coupled to the inputs CODE1 and CODE2, in a first direction of biasing by way of a resistor 425 serving to adjust the current passing through the photodiode 423. An optocoupler 426 comprising an emission photodiode 427 and a reception phototransistor 428 serves to read the verification code on the conductor 100 so as to provide it to a code output denoted CODE3. The photodiode 427 is connected to the terminals of the assembly of diodes 420 and 421 by way of the phototransistor 424. The diodes 420, 421 and 427 are biased so that, when the switching diode 420 is in an enabled state, the photodiode 427 is in a necessarily disabled state. In the absence of the security voltage $V_{sec}$, the switching diode 420 is disabled, the Zener diode 421 limits the voltage across the terminals of the branch consisting of the phototransistor 424 and of the photodiode 427, and when the phototransistor 424 is disabled, the Zener diode 421 furthermore ensures the biasing of the verification circuit 402. A resistor 429 biases the phototransistor 428 so as to be able to recover a signal on the code output CODE3.

The verification circuit 402 comprises a diode device inserted onto the conductor 101. The diode device consists here of a switching diode 430 coupled in parallel with a Zener diode 431. An optocoupler 432 comprising an emission photodiode 433 and a phototransistor 434 serves to provide the conductor 101 with the verification code. The photodiode 433 is coupled to the inputs CODE1 and CODE2, in a second direction of biasing by way of the resistor 425 serving to adjust the current passing through said photodiode. It should be noted that the resistor 425 is sized only for a single photodiode since the photodiodes 423 and 433 are shown head-to-tail and therefore only one can be enabled.

An optocoupler 436 comprising an emission photodiode 437 and a reception phototransistor 438 serves to read the verification code on the conductor 101 so as to provide it to a code output denoted CODE4. The photodiode 437 is connected across the terminals of the assembly of diodes 430 and 431 by way of the phototransistor 434. The diodes 430, 431 and 437 are biased so that, when the diode 430 is in an enabled state, the diode 437 is found to be in a necessarily disabled state. A resistor 439 biases the phototransistor 438 so as to be able to recover a signal on the output CODE4.

The photodiodes 423 and 433 being reverse biased, the bias circuits 401 and 402 operate in a complementary manner. The effect of this is to have different output laws for the outputs CODE3 and CODE4.

In the case where one wishes to despatch an active command, that is to say in a permissive state, the command signal is set to 1. This command signal biases the photodiode 330 of the optocoupler 320 by way of the resistor 331. The photodiode 330 emits luminous radiation towards the phototransistor 332 of the optocoupler 320 thereby enabling it. The resistors 333 and 334 are then traversed by a current. The voltage across the terminals of the resistor 334 then becomes equal to the product of this current times its resistance. The value of this resistance 334 is chosen such that, traversed by this current, the voltage at these terminals is sufficient for the MOS transistors 321 and 323 to be enabled. The MOS transistor 323 being enabled, a current flows through the resistor 324 and the gate voltage of the MOS transistor 325 is found to be almost zero, thus disabling this MOS transistor 325 which prevents the supply voltage $V_{DD-}$ from being provided to the conductor 100. The MOS transistor 321 being enabled, the latter causes a current to cross the resistors 336 and 337. These resistors 336 and 337 thus create a resistor bridge between the supply voltage $V_+$ and the supply voltage $V_{DD-}$. It should be noted that, $V_{DD+}$ being linked to $V_-$, this voltage is equal to the sum of the bias voltage $V_{DD}$ and of the security voltage $V_{sec}$, in our example 60 V. The resistors 336 and 337 thus form a resistor bridge which applies a non-zero voltage between the gate and the source of the MOS transistor 322, thereby enabling it. The conductor 100 is then connected to the supply voltage $V_+$. The resistors 412 and 413 of the autoswitching device 410 create a non-zero potential between the gate and the source of the MOS transistor 411 closing the latter. Thus, the command is despatched. The switching diodes 420 and 430 are enabled and the current flows through a load (not represented). The load is then energized by a voltage substantially equal to the security voltage $V_{sec}$. The switching diodes 420 and 430 being enabled, the photodiodes 427 and 437 can in no case be enabled, the outputs CODE3 and CODE4 are both equal to the supply voltage $V_{CC}$ independently of the code that is despatched on the inputs CODE1 and CODE2.

When the command signal is equal to 0, the photodiode 330 is disabled and emits no signal. The phototransistor 332 is then disabled. The gate voltages of the MOS transistors 321 and 333 are brought back to the source potential of said MOS transistors 321 and 323 by way of the resistor 334, thus disabling said MOS transistors 321 and 323. The gate voltage of the MOS transistor 322 is brought back to the potential of its source by way of the resistor 337, thus disabling the MOS transistor 322. Automatically, the voltage in the resistor bridge 412 and 413 of the autoswitching device 410 becomes zero disabling the MOS transistor 411 which opens the circuit and disconnects the load from the conductor 101. The MOS transistor 323 being disabled, the gate/source voltage of the MOS transistor 325 is equal to the bias voltage $V_{DD}$ thus enabling this transistor 325, this having the effect of linking the supply voltage $V_{DD-}$ to the conductor 100 by way of the resistor 202. This bias being reversed for the switching diodes 420 and 430 and Zener diodes 421 and 431 and being forward for said diode 306, a bias path is established between $V_{DD+}$ and $V_{DD-}$ which is then constituted by the Zener diode 431, the biasing diode 310, the Zener diode 321 and the resistor 202.

When the input CODE1 is at a positive voltage and the input CODE2 is at a zero voltage, the photodiode 423 is biased by the resistor 425 and becomes light emitting towards the phototransistor 424, enabling the photodiode 427 which emits towards the phototransistor 428 which links the output CODE3 to earth. Simultaneously, the photodiode 433 is reverse biased, thus disabling the transistor 434 which disables the photodiode 437 and hence also the phototransistor 438. The output CODE4 then provides a positive voltage. The branch consisting of the phototransistor 434 and of the photodiode 437 being disabled, the bias current flows through the Zener diode 431 which ensures the regulation at its terminals of the potential at most equal to its Zener voltage.

When the input CODE1 is at a zero voltage and the input CODE2 is at a positive voltage, the photodiode 433 is biased by the resistor 425 and becomes light emitting towards the phototransistor 424, enabling the photodiode 437 which emits towards the phototransistor 438 which links the output CODE4 to earth. Simultaneously, the photodiode 423 is found to be reverse biased, thus disabling the transistor 424 which disables the photodiode 427 and hence also the phototransistor 428. The output CODE3 then provides a positive voltage. The branch consisting of the phototransistor 424 and of the photodiode 427 being disabled, the bias current flows through the Zener diode 421 which ensures the regulation at its terminals of the potential at most equal to its Zener voltage.

When the inputs CODE1 and CODE2 are at the same potential, positive or zero voltage, the photodiodes 423 and 433 are both disabled. The phototransistors 424 and 434 are then disabled as are the photodiodes 427 and 437 and the phototransistors 428 and 438. The outputs CODE3 and CODE4 then provide a positive voltage. The law of the outputs CODE3 and CODE4 may be expressed thus:

$$\text{CODE3} = \overline{\text{CODE1} \cdot \overline{\text{CODE2}}}$$

$$\text{CODE4} = \overline{\overline{\text{CODE1}} \cdot \text{CODE2}}.$$

The despatching of the verification code is done by a successive despatching of 0 or 1 bits which translates into a positive, negative or zero potential difference between the inputs CODE1 and CODE2. This alternation of bits produces, within the framework of normal operation, the outputs CODE3 and CODE4 according to the law expressed previously, when a security stage is requested by the command signal. It should be noted that if the inputs CODE1 and CODE2 are complementary to one another, the outputs CODE3 and CODE4 will also be complementary to one another.

In case of malfunction during a command in the security state which corresponds to despatching no power signal to the load, several phenomena may occur. A first failure may be a sticking of the MOS transistor 322 which, for example, would have burnt out following an overheat and would become a short circuit. Regardless of the command voltage, the load would be permanently connected to the security voltage $V_{sec}$. In this case, the diodes 420 and 430 are necessarily enabled and systematically prevent the photodiodes 427 and 437 from being enabled, it is not possible, in this case, to recover code on one of the outputs CODE3 or CODE4. Likewise, if the transistor 322 operates correctly and sticking originating from a short-circuit downstream of the secure output interface occurs and energizes the load, a current passing through just one of the conductors would give rise for this conductor to the zeroing of the corresponding output signal. In case of failure of one of the verification circuits 401 or 402, the corresponding code output would necessarily be set either to 0, or to 1 and would be unable to retransmit the verification code which is associated with it. The security validation circuit 2 despatches the verification codes and recovers the signals originating from the outputs CODE3 and CODE4. If the outputs do not comply with the codes despatched, the security validation circuit 2 reckons that the outputs are no longer secure and hence cuts off the security supply of the whole system.

The invention is described within the application framework of a secure command circuit for a vehicle. The invention is not limited to an application limited to a vehicle but to all types of use requiring a secure command circuit integrating an output interface that is itself secure.

The invention claimed is:

1. Secure verification device of the despatching of a binary command signal on at least one conductor having an input terminal and an output terminal, the device comprising:

means of insertion of a verification message onto said conductor, at least one optical coupler having an emission diode coupled to the conductor so as to copy the verification message when the binary signal is in a first state and not to copy it when it is in a second state different from the first state.

2. Device according to claim 1, in which a first of the at least one conductor is furnished with a first monitoring diode placed between its input terminal and its output terminal, said diode being placed so as to be disabled when the binary signal is in the first state and so as to allow the current to pass through the first conductor when the binary signal is in the second state, in which the means of insertion comprise a transistor which couples in parallel a first emission diode with the first monitoring diode when said transistor is enabled, the first emission diode being biased in such a way that the latter is disabled independently of the state of the transistor when said first monitoring diode is enabled, and in which the device comprises biasing means which make it possible to reverse bias the first monitoring diode when the binary signal is in the first state.

3. Device according to claim 2, in which the transistor is a phototransistor of an optical coupler having a first emission diode excited by the verification signal.

4. Device according to claim 2, in which the binary signal is despatched on two conductors having their output terminals linked to a load, a continuous security voltage being applied between the input terminals of the two conductors when the binary signal is in the second state.

5. Device according to claim 2, in which the biasing means comprise a continuous bias voltage source reverse biasing the first monitoring diode, said source being connected to the first conductor at the level of the terminals of the first monitoring diode by way of two resistors.

6. Device according to claim 4, in which the biasing means comprise a continuous bias voltage source at the input terminals of the two conductors by way of at least one resistor, the bias voltage being applied to the conductors in a sense opposite to the security voltage.

7. Device according to claim 6, which furthermore comprises a biasing diode placed between the output terminals of the two conductors, the biasing diode being biased so as to be enabled in relation to the current created by the bias voltage and to be disabled in relation to the security voltage.

8. Device according to claim 7, which furthermore comprises a means of autoswitching placed between the output terminals of the two conductors, said autoswitching means disconnecting one of the conductors from a load linked to said conductor.

9. Device according to claim 6, in which the biasing means comprise a breaker which establishes the link between one of the conductors and the bias voltage source when the binary signal is in the first state and which disconnects the voltage source from said conductor when the binary signal is in the second state.

10. Device according to claim 6, which furthermore comprises:

second means of insertion of a verification signal on the second conductor, a second optical coupler having a second emission diode coupled to the second conductor so as to copy the verification message when the binary signal is in a first state and not to copy it when it is in a second state different from the first state.

11. Device according to claim 10, in which the second conductor is furnished with a second monitoring diode placed between its input terminal and its output terminal, said second monitoring diode being placed so as to be disabled when the binary signal is in the first state and so as to allow the current to pass through the second conductor when the binary signal is in the second state, and in which the means of insertion is a second transistor which couples in parallel the second emission diode with the second monitoring diode when said transistor is enabled, the second emission diode being biased in such a way that the latter is disabled independently of the state of the transistor when a voltage applied to the terminals of the second monitoring diode enables said second monitoring diode.

12. Device according to claim 11, in which the transistor is a phototransistor of an optical coupler having an emission diode excited by the verification message.

13. Device according to claim 2, in which the first and possibly the second monitoring diode is a switching diode.

14. Device according to claim 2, in which the first and possibly the second monitoring diode is a Zener diode.

15. Device according to claim 2, in which the first and possibly the second monitoring diode consists of a switching diode and of a Zener diode in parallel, the two diodes being biased in the same sense.

16. Device according to claim 1, in which the binary command signal is a power command despatched on two conductors creating a continuous security potential difference between the two conductors when the binary signal is in the second state and allowing said conductors to float when the binary signal is in the first state, in which the means of insertion consist of a capacitor and two resistors coupled to the conductors and despatching a differential verification message, of variable potential, whose amplitude is less than the secure potential difference, and in which the emission diode is placed between the two conductors in such a way as to be disabled when the secure potential difference is applied to said conductors.

17. Device according to claim 16, in which each conductor has an input terminal and an output terminal, in which one of the conductors is furnished with a switching diode whose bias allows the current to pass when the secure potential difference is applied to the two conductors when they are linked to load, and in which the connection nodes of the capacitor and of the emission diode which are situated on the conductor furnished with the switching diode, are placed between the input terminal and the switching diode.

18. Device according to claim 1, in which the output terminals of the conductors are linked to a biased relay.

19. Secure command system comprising:

means of generation of a command, means of verification which verify the proper operation of said system, means of security energizing which provide a security voltage under the monitoring of the verification means, means of despatch of the command in a secure manner with the aid of the security voltage, wherein the means of despatch comprise at least one secure verification device of the despatching of a binary command signal on at least one conductor having an input terminal and an output terminal, the device comprising:

means of insertion of a verification message onto said conductor, at least one optical coupler having an emission diode coupled to the conductor so as to copy the verification message when the binary signal is in a first state and not to copy it when it is in a second state different from the first state.

20. System according to claim 19, in which the verification message is provided by the verification means, and in which the verification message copied is provided to the verification means, said verification means monitoring the integrity of the message passed on the conductor when the binary signal is in the first state.

21. System according to claim 20, in which, if one of the verification messages copied on the conductor does not comply with the verification messages despatched, the means of verification cut off the security means of energizing, so that the means of despatch are no longer energized with the security voltage.

22. System according to claim 19, wherein said at least one secure verification device is arranged according to any one of claims 1 to 18.

23. Transport vehicle comprising a secure command system comprising:

means of generation of a command, means of verification which verify the proper operation of said system, means of security energizing which provide a security voltage under the monitoring of the verification means, means of despatch of the command in a secure manner with the aid of the security voltage, wherein the means of despatch comprise at least one secure verification device of the despatching of a binary command signal on at least one conductor having an input terminal and an output terminal, the device comprising:

means of insertion of a verification message onto said conductor, at least one optical coupler having an emission diode coupled to the conductor so as to copy the verification message when the binary signal is in a first state and not to copy it when it is in a second state different from the first state.

24. Transport vehicle according to claim 23, in which the verification message is provided by the verification means, and in which the verification message copied is provided to the verification means, said verification means monitoring the integrity of the message passed on the conductor when the binary signal is in the first state.

25. Transport vehicle according to claim 24, in which, if one of the verification messages copied on the conductor does not comply with the verification messages despatched, the means of verification cut off the security means of energizing, so that the means of despatch are no longer energized with the security voltage.

26. Transport vehicle according to claim 23, wherein said at least one secure verification device is arranged according to any one of claims 1 to 18.

* * * * *